US009835355B2

(12) United States Patent
Evans

(10) Patent No.: US 9,835,355 B2
(45) Date of Patent: Dec. 5, 2017

(54) INTER-AXIAL INLINE FLUID HEATER

(75) Inventor: Robert Evans, Sturbridge, MA (US)

(73) Assignee: Infinity Fluids Corp., Worcester, MA (US)

( * ) Notice: Subject to any disclaimer, the term of this patent is extended or adjusted under 35 U.S.C. 154(b) by 588 days.

(21) Appl. No.: 13/396,786

(22) Filed: Feb. 15, 2012

(65) Prior Publication Data

US 2012/0141100 A1 Jun. 7, 2012

Related U.S. Application Data

(63) Continuation-in-part of application No. 12/261,408, filed on Oct. 30, 2008, now Pat. No. 8,380,056.

(60) Provisional application No. 60/984,563, filed on Nov. 1, 2007.

(51) Int. Cl.

| | |
|---|---|
| ***F24H 1/10*** | (2006.01) |
| ***F24H 1/14*** | (2006.01) |
| ***H05B 3/42*** | (2006.01) |

(52) U.S. Cl.

CPC ..... *F24H 1/142* (2013.01); *H05B 3/42* (2013.01); *F24H 2250/02* (2013.01)

(58) Field of Classification Search

USPC ..... 392/478–484

See application file for complete search history.

(56) References Cited

U.S. PATENT DOCUMENTS

| | | | | |
|---|---|---|---|---|
| 3,378,673 | A * | 4/1968 | Hopper | 392/472 |
| 4,567,350 | A * | 1/1986 | Todd, Jr. | 392/486 |
| 2004/0108310 | A1* | 6/2004 | Furlong et al. | 219/544 |
| 2005/0274714 | A1* | 12/2005 | Lin | 219/543 |

* cited by examiner

*Primary Examiner* — Thor Campbell

(74) *Attorney, Agent, or Firm* — Law Offices of Daniel A. Tesler, LLC

(57) ABSTRACT

An inter-axial inline fluid heater is presented. The inter-axial inline fluid heater includes an outer retaining sheath defining a first area, and an interior flow tube disposed within the outer sheath and capable of having fluid flow therethrough. Further, the inter-axial inline fluid heater includes a resistance wire disposed between the interior flow tube and the outer retaining sheath, the resistance wire capable of producing heat for heating a fluid passing through the interior flow tube when power is applied to the resistance wire. Also includes is a dielectric heat transfer material disposed between the interior flow tube and the outer retaining sheath and surrounding at least a portion of the resistance wire.

19 Claims, 11 Drawing Sheets

INTER-AXIAL INLINE FLUID HEATER

CROSS REFERENCE TO RELATED APPLICATIONS

The present application is a continuation-in-part of application Ser. No. 12/261,408 filed Oct. 30, 2008 now U.S. Pat. No. 8,380,056 which claims the benefit of U.S. Provisional Patent Application No. 60/984,563, filed on Nov. 1, 2007, which is incorporated herein by reference in its entirety.

BACKGROUND

Since the inception of electric circulation and inline heaters, there has been a general design principal of placing a heating element into a flowing stream of fluid or material. This element is typically mounted in a flow channel or fluid housing which maintains and envelops the heating element such that the fluid passes over the heating element picking up the energy produced by the heating element. This design is very efficient in nature and is a mainstay among all process and product applications given the inherent capabilities and efficiencies.

Conventional heater technologies include the cartridge style heater where a resistive circuit is coiled and set within a closed end tube and then back filled with dielectric heat transfer materials. This heater design is then incorporated into a housing if it is to be used to heat a moving fluid for forced flow or convective heating.

Another conventional design is a resistive circuit enclosed within a tube surrounded and backfilled by dielectric/heat transfer material, most commonly Magnesium Oxide (MgO2). This style heater is very versatile with configurations including hairpin patterns, corkscrew coils, spring patterns etc. However, all of these winding designs must be included within an additional housing for use as a fluid heater either forced flow or convective flow, otherwise the movement of the fluid will not be channeled across the element making it useless as an effective fluid heater.

A supplementary heating device currently available on the market incorporates a resistive heater as described in either of the above examples with a formed aluminum body which translates the heat energy produced by the heater through the cast aluminum body then into the flow channel carrying the heated media.

SUMMARY

Conventional mechanisms such as those explained above suffer from a variety of deficiencies. One such deficiency is that with customary electric fluid heaters, the heating element is a component within an assembly, which in many cases includes a heating element, a housing to channel the flow across the heating element and transition fittings to adapt from the housing and heater to the process system.

Embodiments of the invention significantly overcome such deficiencies and provide mechanisms and techniques that provide an inter-axial inline fluid heater. The present invention comprises an inter-axial inline fluid heater that overcomes several costly and problematic features associated with conventional fluid heating technologies.

The presently disclosed inter-axial inline fluid heater design disposes of the use of a flow channel or heater housing, and instead incorporates the heated section on the outer wall of a central tube which allows the unit to heat from the outside inward. The spatial savings associated with not requiring an outer housing over the heating element makes the inter-axial inline fluid heater useful in many applications where space and weight savings is paramount to the overall process or design, including automobiles, airplanes/aerospace vehicles, boats/marine vehicles, medical and military applications and the like.

The inter-axial inline fluid heater has several advantages over typical circulation designs, including the economics associated with not having to produce a costly housing to envelop the heating element. Further their weight savings associated with not requiring a metal housing twice the diameter of the element itself. Additionally, the solid state aspect of the inter-axial inline fluid heater make it perfect for processes or products/vehicles which will be subject to impact, massive vibration and overall abuse. All of the components within the heater are either cast or compacted in place, whereas the typical circulation style unit has heater elements not firmly affixed allowing for rattling, vibration and deformation. Further still the manufacturing process for the inter-axial inline fluid heater is less than half that required of manufacturing and fabrication of standard circulation or inline style heaters. Yet further still, without the requirement for a heating element mounted in the center of the flow housing then the pressure drop or resistive effects of the inter-axial inline fluid heater make its employment in any application negligible, allowing for pumps, motors and fans to not have to work as hard as they would with a disruptive heater element in its flow path. Still another advantage is that with the present inter-axial inline fluid heater, exotic materials and super alloys, such as inconel, titanium, quartz, teflon, pfa polymer can all be employed with sparing requirements as they are required in their most common geometry, the tube. Entire flow chambers and fittings would not have to be used to make all wetted components including the heater out of prohibitively expensive compounds or materials.

In a particular embodiment, an inter-axial inline fluid heater includes an outer retaining sheath defining a first area, the outer retaining sheath having a first end and a second end and an interior flow tube disposed within the outer sheath and capable of having fluid flow therethrough, the interior flow tube having a first end extending beyond the first end of the outer retaining sheath, the interior flow tube having a second end extending beyond the second end of the outer retaining sheath. The inter-axial inline fluid heater further includes a resistance wire having a first power lead at a first end and a second power lead at a second end thereof, the resistance wire disposed between the interior flow tube and the outer retaining sheath, the resistance wire capable of producing heat for heating a fluid passing through the interior flow tube when power is applied to the resistance wire. Additionally, the inter-axial inline fluid heater includes a dielectric heat transfer material disposed between the interior flow tube and the outer retaining sheath and surrounding at least a portion of the resistance wire.

With the inter-axial inline fluid heater, the housing and transition adapters are built integrally to the design of the heater disposing of several components/assemblies required to operate conventional technologies. Only a single component to entail the full flow channel, fitting transitions and heater circuit are required to operate the inter-axial inline fluid heater.

Note that each of the different features, techniques, configurations, etc. discussed in this disclosure can be executed independently or in combination. Accordingly, the present invention can be embodied and viewed in many different ways.

Also, note that this summary section herein does not specify every embodiment and/or incrementally novel aspect of the present disclosure or claimed invention. Instead, this summary only provides a preliminary discussion of different embodiments and corresponding points of novelty over conventional techniques. For additional details, elements, and/or possible perspectives (permutations) of the invention, the reader is directed to the Detailed Description section and corresponding figures of the present disclosure as further discussed below.

BRIEF DESCRIPTION OF THE DRAWINGS

The foregoing will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

By way of the presently disclosed inter-axial inline fluid heater, the housing and transition adapters are built integrally to the design of the heater disposing of several components assemblies required to operate conventional technologies. Only a single component to entail the full flow channel, fitting transitions and heater circuit are required to operate the inter-axial inline fluid heater unit.

In the typical manufacturing and construction of the inter-axial inline fluid heater, the minor (flow tube) and major (outer retaining sheath) diameters are cut to prescribed length, dictated by application, wattage and voltage requirements. In most designs the minor diameter tube will be cut several inches longer than the major diameter tube, which will allow for fluid transition fittings to be affixed to the minor diameter length after it is manufactured. Next the resistive wire is positioned within extruded dielectric tubes and either run helically around the minor diameter tube or sinuously along its length depending on resistive requirements. The major diameter tube is then positioned over both the minor diameter tube and the resistive wire and extruded dielectric tubes. One end of the minor and major diameter cross section is then capped off and the vacant area within the two tubes is then filled and vibrated with granular dielectric materials. (This process can also be performed with flowing castable materials or cast without the major diameter tube in some conditions). The entire unit but primarily the major diameter tube is sent thru a reduction process which will compact the internals of the unit making the granular material more of a solid, reducing or eliminating the air gaps and voids in the granules, allowing for greater heat transfer characteristics. Electrical conductor leads are then affixed to the cold pins allowing for flexibility in wiring and connection to process.

Figure 1:
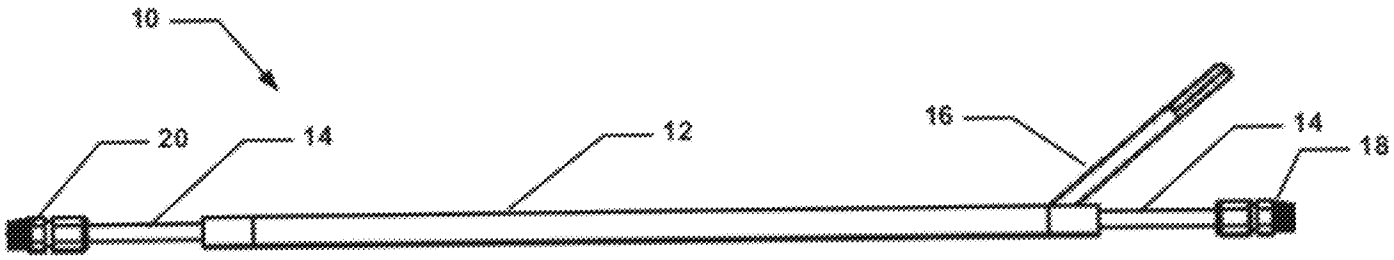
FIG. 1 depicts a diagram of one embodiment of an inter-axial inline fluid heater in accordance with embodiments of the invention.

Referring now to FIG. 1, a diagram of an inter-axial inline fluid heater 10 is shown. The inter-axial inline fluid heater 10 includes an outer retaining sheath 12 having a first end and a second end. Disposed within the outer retaining sheath 12 is an interior flow tube 14. Interior flow tube 14 extends beyond the ends of outer retaining sheath 12. The inter-axial inline fluid heater 12 also includes a resistance wire 16 having first and second power leads. Resistance wire 16 is disposed between the interior flow tube 14 and the outer retaining sheath 12. The resistance wire 16 is capable of producing heat when a voltage is applied, the heat generated by resistance wire 16 heating fluid passing through interior flow tube 14.

A first transition header 18 is shown at a first end of the interior flow tube 14. The first transition header is used to couple the inter-axial inline fluid heater 10 to a fluid source. A second transition header 20 is shown attached at a second end of interior flow tube 14. The second transition header 20 is used for coupling the inter-axial inline fluid heater 10 to a fluid destination. This version of the inter-axial inline fluid heater is useful high power low ohm heating applications.

Figure 2:
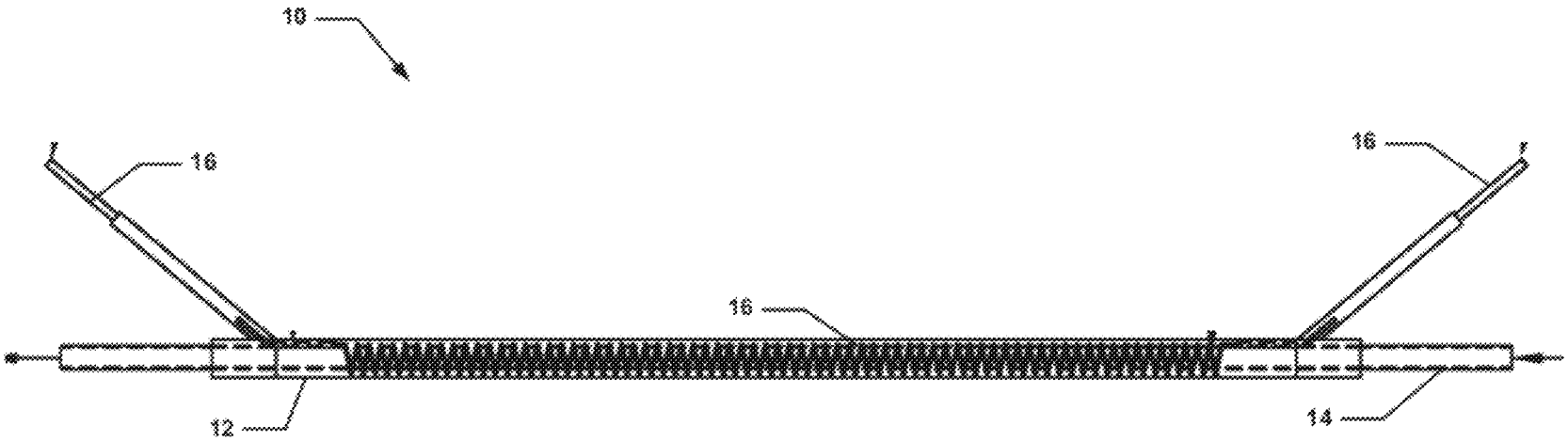
FIG. 2 depicts a cross-sectional side view of an inter-axial inline fluid heater having a coiled resistance wire in accordance with embodiments of the invention.
Figure 3:
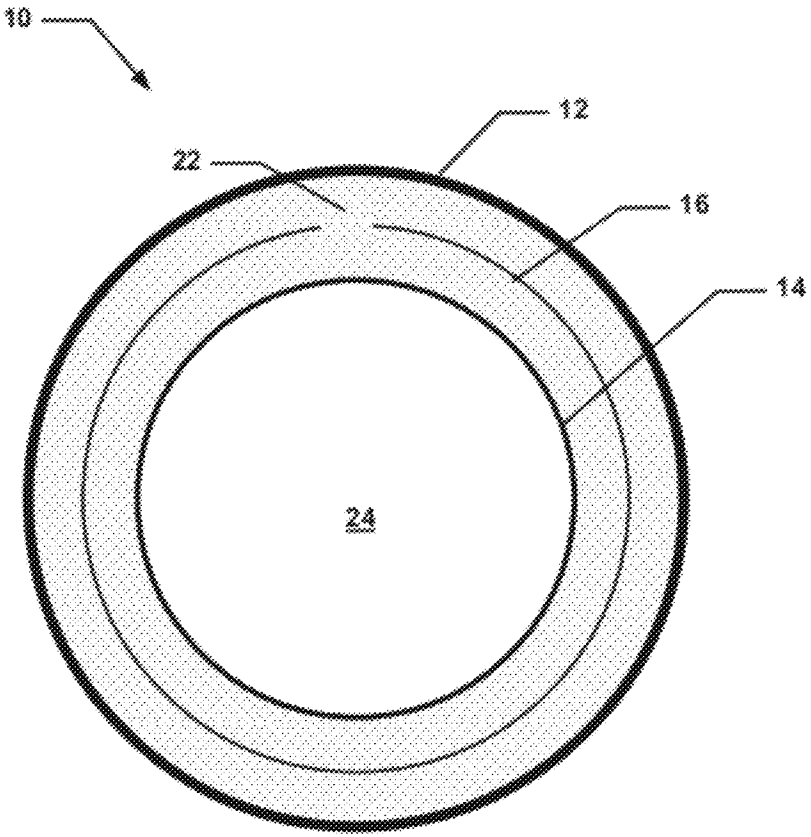
FIG. 3 depicts a cross-sectional end view of inter-axial inline fluid heater having a coiled resistance wire as shown in FIG. 2.

Referring now to FIG. 2, a cross-sectional side view of an inter-axial inline fluid heater 10 is shown, and in FIG. 3, a cross-sectional end view is shown. In this example, the inter-axial inline fluid heater 10 includes an outer retaining sheath 12 having a first end and a second end. Disposed within the outer retaining sheath 12 is an interior flow tube 14. Interior flow tube 14 extends beyond the ends of outer retaining sheath 12. The inter-axial inline fluid heater 12 also includes a resistance wire 16 having first and second power leads. Resistance wire 16 is disposed between the interior flow tube 14 and the outer retaining sheath 12. The resistance wire is coiled around the interior flow tube 14. Also shown is dielectric heat transfer material 22 disposed between the interior flow tube 14 and said outer retaining sheath 12 and surrounding at least a portion of the coiled resistance wire 16.

Figure 4:
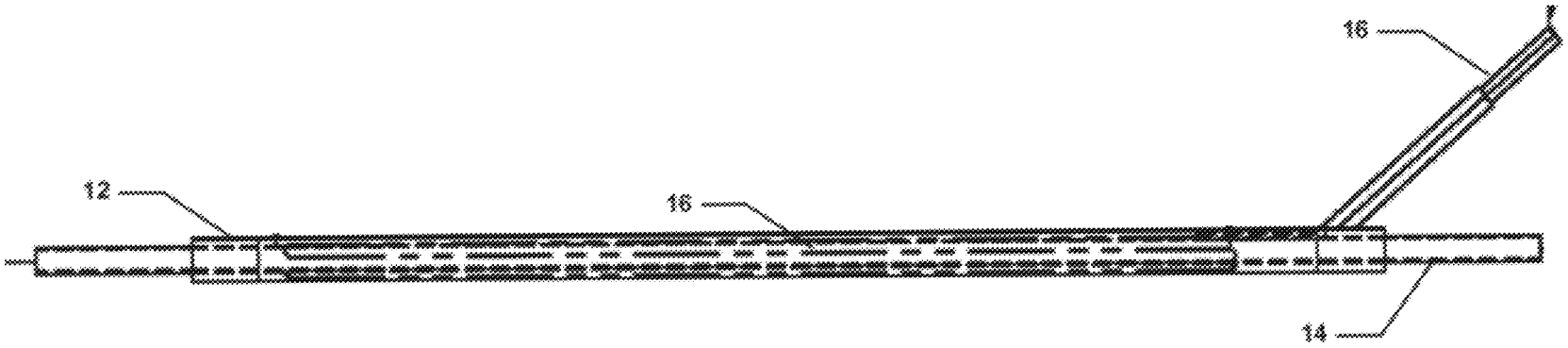
FIG. 4 depicts a cross-sectional side view of inter-axial inline fluid heater having a sinuated resistance wire in accordance with embodiments of the invention.
Figure 5:
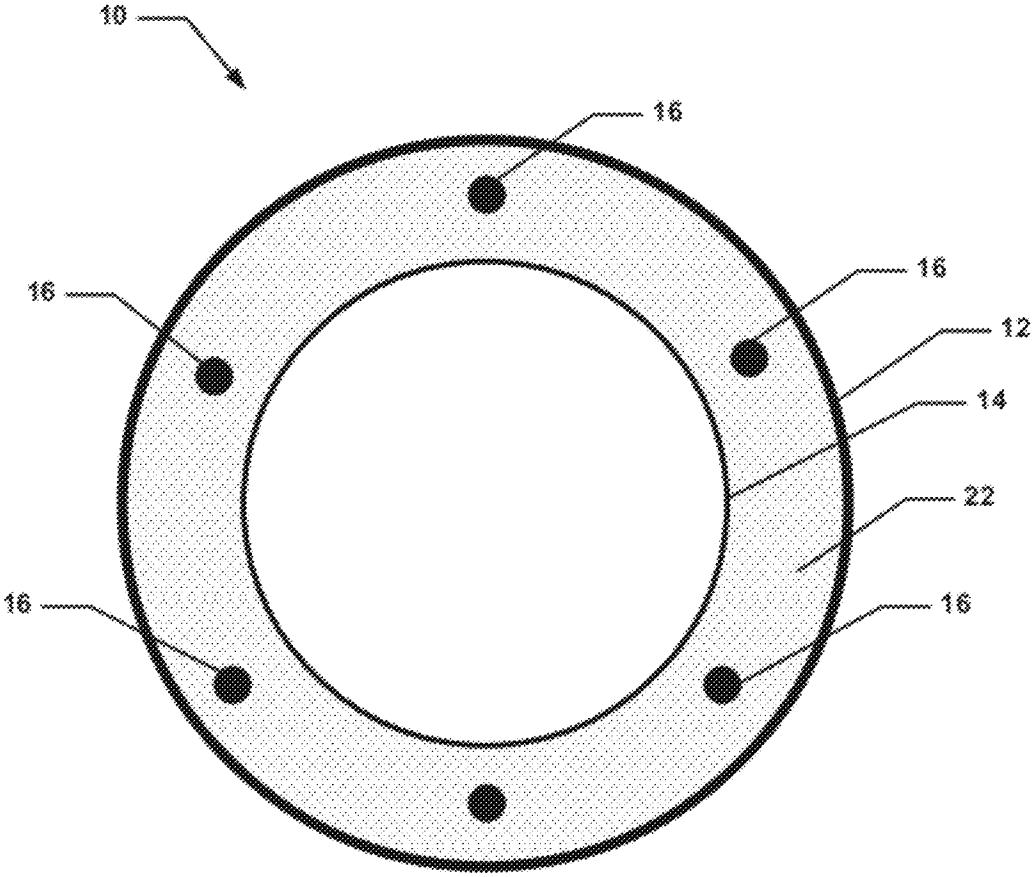
FIG. 5 depicts a cross-sectional end view of inter-axial inline fluid heater having a sinuated resistance wire as shown in FIG. 4.

Referring now to FIG. 4, a cross-sectional side view of an inter-axial inline fluid heater 10 is shown, and in FIG. 5, a cross-sectional end view is shown. In this example, the inter-axial inline fluid heater 10 includes an outer retaining sheath 12 having a first end and a second end. Disposed within the outer retaining sheath 12 is an interior flow tube 14. Interior flow tube 14 extends beyond the ends of outer retaining sheath 12. The inter-axial inline fluid heater 12 also includes a resistance wire 16 having first and second power leads. Resistance wire 16 is disposed between the interior flow tube 14 and the outer retaining sheath 12. The resistance wire is sinuated about the interior flow tube 14. Also shown is dielectric heat transfer material 22 disposed between the interior flow tube 14 and said outer retaining sheath 12 and surrounding at least a portion of the sinuated resistance wire 16.

Figure 6:
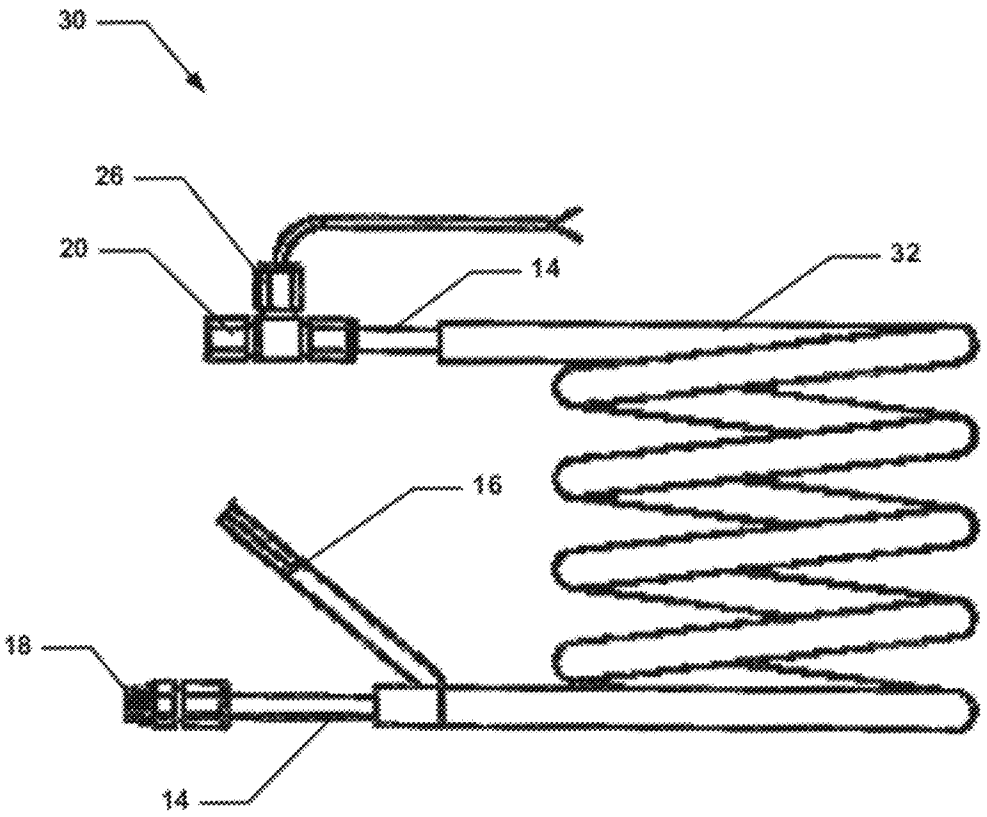
FIG. 6 depicts a diagram of an inter-axial inline fluid heater having a coiled configuration in accordance with embodiments of the invention.

Referring now to FIG. 6, a coiled inter-axial inline fluid heater 30 is shown. The heater 30 includes an outer retaining sheath 32 having a first end and a second end, which is formed into a coiled shape. Disposed within the outer retaining sheath 32 is an interior flow tube 14. Interior flow tube 14 extends beyond the ends of outer retaining sheath 32. The inter-axial inline fluid heater 30 also includes a resistance wire 16 having first and second power leads. Resistance wire 16 is disposed between the interior flow tube 14 and the outer retaining sheath 32. The resistance wire 16 is capable of producing heat when a voltage is applied, the heat generated by resistance wire 16 heating fluid passing through interior flow tube 14.

A first transition header 18 is shown at a first end of the interior flow tube 14. The first transition header is used to couple the inter-axial inline fluid heater 30 to a fluid source. A second transition header 20 is also shown attached at a second end of the inter-axial inline fluid heater assembly. The second transition header 20 is used for coupling the inter-axial inline fluid heater 30 to a fluid destination. Also shown in this embodiment is a thermocouple 26. Thermocouple 26 is coupled between the interior flow tube 14 and the second transition header 20. Thermocouple 26 is used for monitoring the temperature of the heated fluid leaving the inter-axial fluid heater assembly. This coiled version of the inter-axial inline fluid heater 30 is useful for low wattage, high ohm resistive heating applications.

Figure 7:
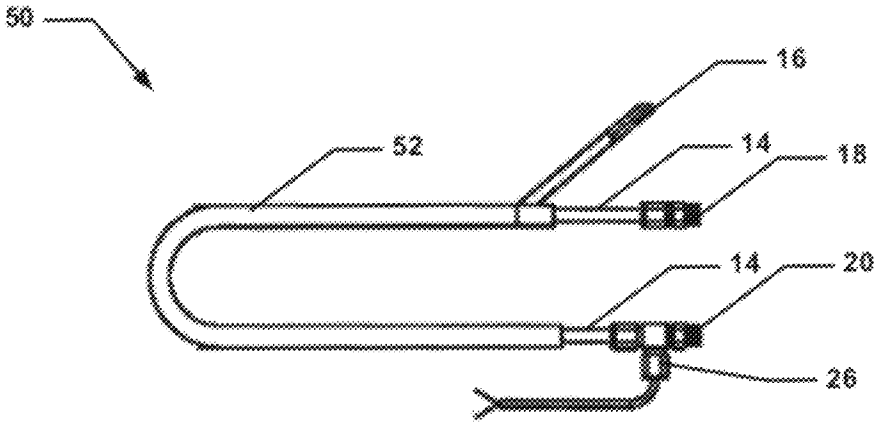
FIG. 7 depicts a diagram of an inter-axial inline fluid heater having a curved configuration in accordance with embodiments of the invention.
Figure 8:
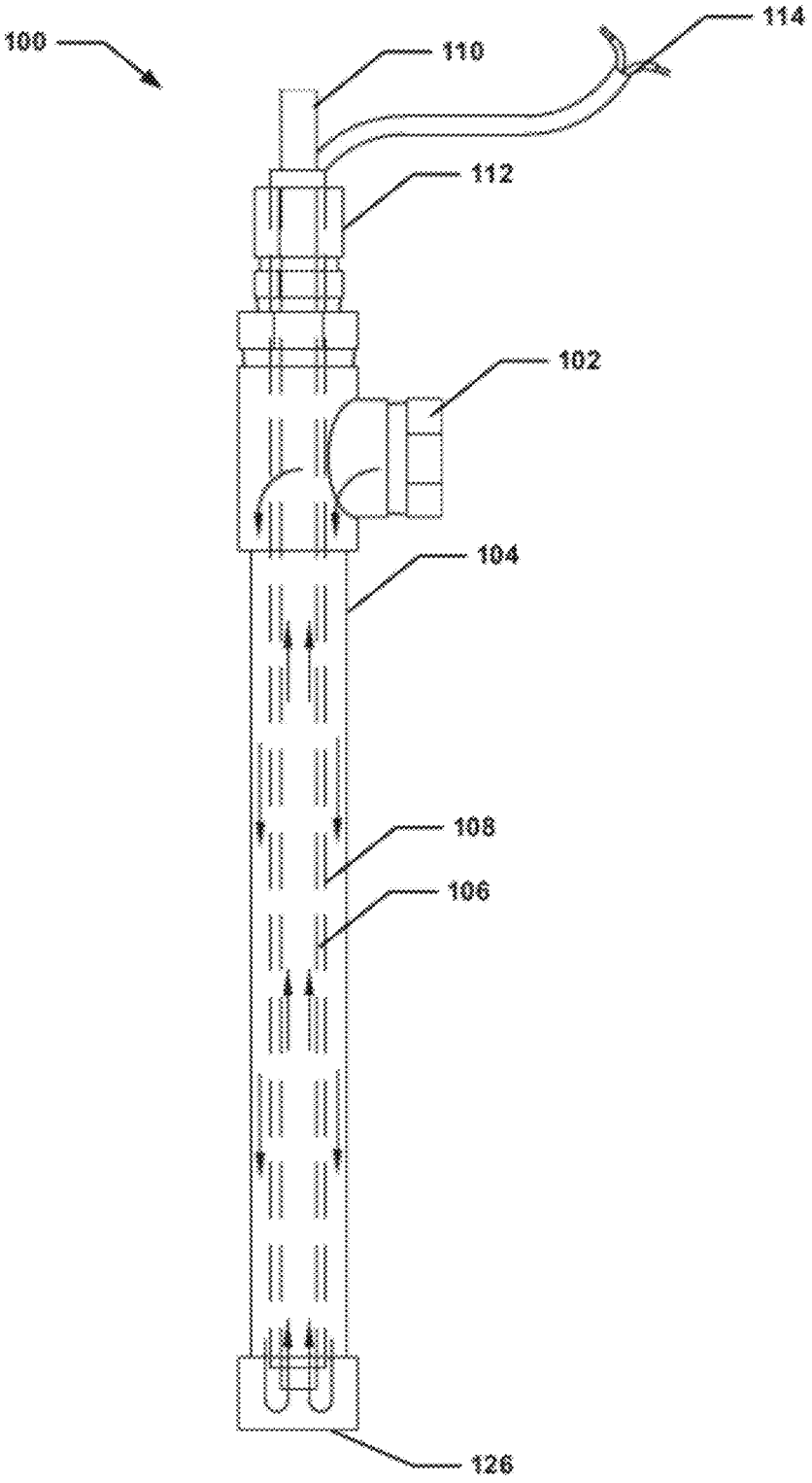
FIG. 8 depicts a diagram of a fast response fluid heater showing an internal heater in accordance with further embodiments of the invention.
Figure 9:
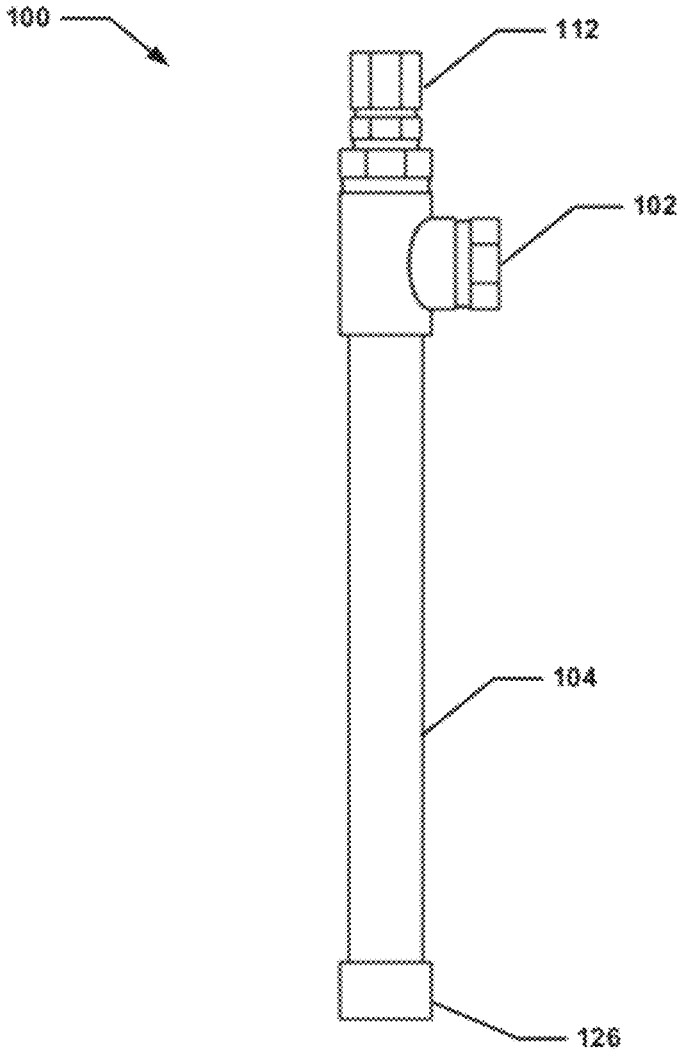
FIG. 9 depicts a diagram of an external view of the fast response fluid heater in accordance with further embodiments of the invention.
Figure 10:
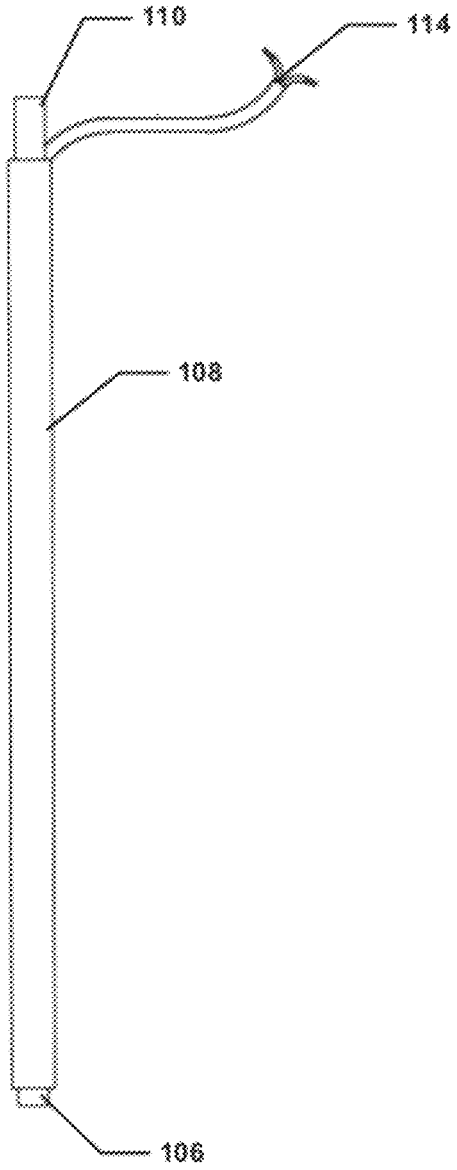
FIG. 10 depicts a diagram of an internal heater of the fast response fluid heater in accordance with further embodiments of the invention.

Referring now to FIG. 7, a curved inter-axial inline fluid heater 50 is shown. The heater 50 includes an outer retaining sheath 52 having a first end and a second end, which is formed into a curved shape. Disposed within the outer retaining sheath 52 is an interior flow tube 14. Interior flow tube 14 extends beyond the ends of outer retaining sheath 52. The inter-axial inline fluid heater 50 also includes a resistance wire 16 having first and second power leads. Resistance wire 16 is disposed between the interior flow tube 14 and the outer retaining sheath 52. The resistance wire 16 is capable of producing heat when a voltage is applied, the heat generated by resistance wire 16 heating fluid passing through interior flow tube 14.

A first transition header 18 is shown at a first end of the interior flow tube 14. The first transition header is used to couple the inter-axial inline fluid heater 50 to a fluid source. A second transition header 20 is also shown attached at a second end of the inter-axial inline fluid heater assembly. The second transition header 20 is used for coupling the inter-axial inline fluid heater 50 to a fluid destination. Also shown in this embodiment is a thermocouple 26. Thermocouple 26 is coupled between the interior flow tube 14 and the second transition header 20. Thermocouple 26 is used for monitoring the temperature of the heated fluid leaving the inter-axial fluid heater assembly. The curved version of the inter-axial inline fluid heater 50 is useful for low wattage, high ohm resistive heating applications, as well as high power low ohm heating applications.

The inter-axial inline fluid heater design incorporates the durability of the circulation style cartridge and tubular heaters both compacted and un-compacted, with the utility and space savings of flexible cable heaters. The useful temperature is dependent upon the materials of construction. The inter-axial inline fluid heater disposes of both the independent heater embedded within the casting and the helically coiled fluid channel also embedded within the casting making for a far more spatially effective, reduced weight with cost benefits as compared to the conventional designs.

The inter-axial inline fluid heater design incorporates both the flow path and the resistive circuit within a single component, disposing of both the spatially inefficient and costly housing design required to channel the flow across the element. With inter-axial inline fluid heater the flow path moves through the central axis of the heater and the unit operates from the outside in versus the inside out like all conventional technologies.

The inter-axial inline fluid heater is a useful design within any application that requires the efficient use of space, utility and monetary savings. The inter-axial inline fluid heater can be used to effectively heat: air, gas, water, liquid, steam, multiphase fluids, super heated and super critical fluids and can also be used as a steam generation device, both saturated and super heated phases. The inter-axial inline fluid heater can be constructed in lengths from 1" to limitless runs, used as straight heated process piping, or bent to any configuration that standard tubing can be bent to accommodate piping runs or confined spaces. Straight wire resistive circuits can be used to allow for high power low ohm heating applications or coiled to allow for low wattage high ohm resistive heating applications. Different tube material can be used as fluid flow channel, including but not limited to copper, brass, stainless steel, titanium, inconel products, nickel, or the like. Further, any tube shaped material, including but not limited to square, round, patterned and the like, can be used within the inter-axial inline fluid heater design.

Another embodiment, referred to herein as a Fast Response Fluid Heater, is shown in FIGS. 8-11. For many years electric heaters have been employed to heat fluids. These electric heaters take many forms, from a storage tank to a cartridge heater mounted in a tube to heat moving volumes of fluid both gaseous and liquid. The most common practice is to heat fluid is to heat a large tank and hold it in a stand-by reservoir at temperature till the fluid is required. This method is slow and inefficient in that you continue to heat the fluid that may or may not be used in the near future, the product which best exemplifies this heater design is the Hubbel Electric Water heater Model SH. Other products heat water at the point-of-use, these heaters are sometimes called inline heaters, they are more efficient but are larger in size and typically as expensive as standard tank style heaters, this product is best exemplified by the Infinity Fluids heater, CRES-ILA.

The presently described Fast Response Fluid Heater improves the size, weight and efficiency of customary heating technology and general usefulness for the end user. Referring now to FIGS. 8-11, the Fast Response Fluid Heater 100 comprises a flow body 104 having a proximal end and a distal and defining an area therein. The flow body 104 has an inlet orifice 102 disposed within a surface of the flow body, the inlet orifice for allowing the flow of a fluid into the flow body. Also shown is an end cap 126 disposed at the distal end of the flow body 104 and sealing the distal end of the flow body 104. A heater is disposed within the flow body.

The heater includes an outer tube 108 defining a first area, the outer tube having a first end and a second end and an inlet tube 106 disposed within the outer tube 108, the inlet tube 106 having a first end and a second end. The heater further includes a resistance wire having a set of power leads 114 extending therefrom, the resistance wire disposed between the inlet tube 106 and the outer tube 108, the resistance wire capable of producing heat for heating a fluid passing along the outer tube 108 and within the inlet tube 106 when power is applied to the resistance wire. A dielectric heat transfer material is disposed between the inlet tube 106 and the outer tube 108 and surrounding at least a portion of the resistance wire.

The Fast Response Fluid Heater also includes an outlet tube 110 having a first end extending outside the flow body 104 and a second end disposed within the flow body 104. A sealing mechanism (e.g. a compression gland) 112 is disposed at the proximal end of the flow body 104, the sealing mechanism 112 sealing the proximal end of the flow body 104 and allowing the outlet tube 112 to extend therethrough and allowing a set of electrical leads 114 for the heater to extend therethrough. In one embodiment the resistance wire comprises a sinuated resistance wire, while in another embodiment the resistance wire comprises a coiled resistance wire.

In use, fluid enters the flow body 104 via the inlet orifice 102, travels along an outer surface of the outer tube 108 and is heated by the outer tube 108, travels along an inner surface of the inlet tube 106 and is heated by the inlet tube 106 and exits the flow body 104 through the outlet tube 110.

Figure 11:
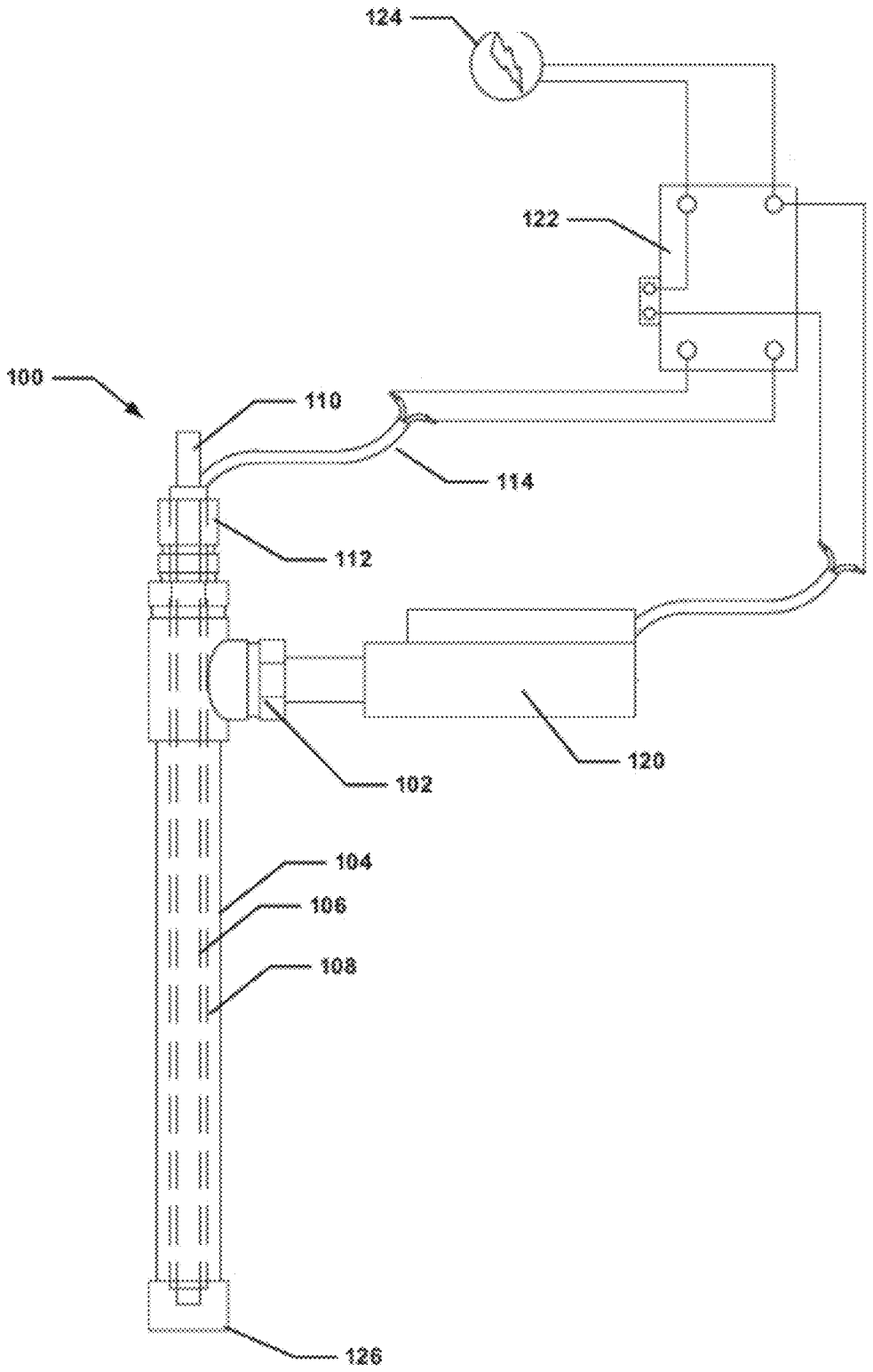
FIG. 11 depicts a diagram of a system incorporating a fast response fluid heater showing an internal heater in accordance with further embodiments of the invention.

In the system of FIG. 11 the fast response fluid heater 100 is shown wherein a flow switch 120 is in fluid communication with the inlet orifice 102. A control contactor coil 122 is in electrical communication with the flow switch 120 and in electrical communication with the power leads 114 of the heater. Also shown is a power supply 124 in electrical communication with the control contactor switch 122.

In use, fluid enters the flow body 104 via the inlet orifice 102 through the flow switch 120. The flow switch 120 detects the fluid and triggers the control contactor coil 122 to provide electrical power from the power supply 124 to the heater resistance wire through leads 114. The fluid travels along an outer surface of the outer tube 108 and is heated by the outer tube 108, travels along an inner surface of the inlet tube 106 and is heated by the inlet tube 106 and exits the flow body 104 through the outlet tube 110.

The above described Fast Responses Fluid Heater employs a heater with a centralized inlet tube, an outlet tube which extends into a flow body and then passes the fluid from the interior of the inlet tube to the exterior of the outlet tube inside of the flow housing, where the media then exits. This improved design uses an inlet tube typically made from material which can handle the rigors of heat stress, mechanical stress and electrical stresses associated with electric heater, a common design material would be stainless steel. The inlet tube is then surrounded by both dielectric material and resistance wire, whereas the resistance wire creates the energy in the form of heat when electrified and transfers its heat into the dielectric material, whereas the dielectric material then conveys the heat energy to both the inlet tube and the outer retaining tube which envelops the inlet tube, the dielectric material and the resistance wire. The resistance wire is then terminated by a transition splice or a splice extension whose purpose is to carry electrical energy without heating until it reaches an area affected by the flow of the fluid media that carries away the heat energy.

In its current design the Fast Response Fluid Heater employs two active heating surfaces. Making use of these two surfaces allows for the improved design to be far more compact, faster responding with the increased surface area in contact with the fluid and reduces the overall watt density of the heater itself yielding a greater longevity product. Most all other products on the market rely on a singular heated surface, which decreases the time to temperature and increases the overall operating temperature of the heating element, which ultimately expedites the failure of the heater itself.

In a standard control design of the Fast Response Fluid Heater, the unit will be supplied with fluid media thru a flow switch of sorts which will sense the movement of liquids and gases. When the flow switch is activated it will close the contact and allow electrical energy to flow to the control contactor coil causing the control contactor to close letting electrical energy to flow to the heater element. When media flow ceases the flow switch will open and the control contactor switch will open causing the electrical energy to stop flowing to the heater element. This is a simple control design making the Fast Response Fluid Heater useful for almost all fluid media heating applications.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

Having described preferred embodiments of the invention it will now become apparent to those of ordinary skill in the art that other embodiments incorporating these concepts may be used. Accordingly, it is submitted that that the invention should not be limited to the described embodiments but rather should be limited only by the spirit and scope of the appended claims.

What is claimed is:

1. A fast response fluid heater comprising:

a flow body having a proximal end and a distal and defining an area therein;

an outer tube within and spaced away from said flow body and an inlet tube within said outer tube, said inlet tube comprised of a first material;

an inlet orifice disposed within a surface of said flow body, said inlet orifice for allowing the flow of a fluid into said flow body;

an outlet tube having a first end extending outside said flow body and a second end disposed within said flow body;

a heater element comprising a resistance wire having a set of power leads extending therefrom, said resistance wire disposed between said inlet tube and said outer tube, said resistance wire capable of producing heat for heating a fluid passing through a space between said flow body and said outer tube and within said inlet tube when power is applied to said resistance wire; and a castable dielectric heat transfer material disposed between said inlet tube and said outer tube and surrounding at least a portion of said resistance wire, wherein said dielectric heat transfer material fills a space between said inlet tube and said outer tube and is in contact with said inlet tube and said outer tube.

2. The fast response fluid heater of claim 1 wherein said resistance wire comprises a sinuated resistance wire.

3. The fast response fluid heater of claim 1 wherein said resistance wire comprises a coiled resistance wire.

4. The fast response fluid heater of claim 1 further comprising a flow switch in fluid communication with said inlet orifice.

5. The fast response fluid heater of claim 4 further comprising a control contactor coil in electrical communication with said flow switch and in electrical communication with said power leads of said heater.

6. The fast response fluid heater of claim 5 further comprising a power supply in electrical communication with a control contactor switch of said control contractor coil.

7. The fast response fluid heater of claim 1 wherein fluid enters said flow body via said inlet orifice, travels along an outer surface of said outer tube and is heated by said outer tube, travels along an inner surface of said inlet tube and is heated by said inlet tube and exits said flow body through said outlet tube.

8. The fast response fluid heater of claim 6 wherein fluid enters said flow body via said inlet orifice through said flow switch, wherein said flow switch detects said fluid and triggers said control contactor coil to provide electrical power from said power supply to said heater resistance wire, and wherein said fluid travels along an outer surface of said outer tube and is heated by said outer tube, travels along an inner surface of said inlet tube and is heated by said inlet tube and exits said flow body through said outlet tube.

9. The fast response fluid heater of claim 1 wherein said heater element comprises:

said outer tube defining a first area, said outer tube having a first end and a second end; and said resistance wire having a set of power leads extending therefrom, said resistance wire disposed within said outer tube, said resistance wire capable of producing heat for heating a fluid passing along said outer tube when power is applied to said resistance wire.

10. The fast response heater of claim 9 wherein said inlet tube has a first end extending beyond said first end of said outer tube, and wherein said inlet tube has a second end extending beyond said second end of said outer tube.

11. The fast response fluid heater of claim 1 wherein fluid enters said flow body via said inlet orifice, travels along a length of said fast response fluid heater and is heated by said heater element, travels along an outer surface of said outer tube and is heated by said outer tube and exits said flow body through said outlet tube.

12. The fast response fluid heater of claim 1 wherein said heater element comprises a cartridge heater.

13. A fast response fluid heater comprising:

a flow body having a proximal end and a distal and defining an area therein;

a heater element mounted within the flow body containing an exterior flow path, where said exterior flow path is the area between the heater element and the flow body, and an integral interior flow path such that a fluid passes singularly along one of said interior flow path and said exterior flow path prior to entering an other one of said interior flow path and said exterior flow path; and wherein said heater element is within said flow body and is inserted through said flow body such that one end of said heater element is isolated from the flow path and the heater element has an interior flow section capable of carrying all of a volumetric flow, and wherein heater element conductive leads are secured via a castable dielectric heat transfer material capable of forming a hermetic seal, wherein said dielectric heat transfer material fills a space between said interior flow path and said exterior flow path and is in contact with said interior flow path and said exterior flow path.

14. The fast response fluid heater of claim 13 wherein said flow body has a generally tubular shape.

15. The fast response fluid heater of claim 13 wherein said heater element comprises a cartridge heater.

16. The fast response fluid heater of claim 13 wherein said heater element comprises a resistance wire.

17. A fast response fluid heater comprising:

a flow body having a proximal end and a distal and defining an area therein;

a heater element mounted within said flow body, having an outside diameter surface spaced away from said flow body, and an inside diameter surface, said heater element centrally disposed within said flow body wherein said heater element includes a built in flow path acting as a port which is exposed beyond a limit of said flow body allowing for process connection built integrally to an element support structure, wherein a second flow path is located between the outside diameter surface of said heater element and said flow body, and wherein a castable dielectric heat transfer material fills a space between within said heater and is in contact with said heater.

18. The fast response fluid heater of claim 17 wherein said heater element comprises a cartridge heater.

19. The fast response fluid heater of claim 17 wherein said heater element comprises a resistance wire.

* * * * *